US005307538A

United States Patent [19]

Rench et al.

[11] Patent Number: 5,307,538

[45] Date of Patent: May 3, 1994

[54] CARPET CLEANING MACHINE FOR PARTICULATE REMOVAL

[75] Inventors: Geoffrey B. Rench, Racine, Wis.; Stephen Jacobs, Bayside; Frank Jolly, Arcata, both of Calif.

[73] Assignee: Racine Industries, Inc., Racine, Wis.

[21] Appl. No.: 68,151

[22] Filed: May 28, 1993

Related U.S. Application Data

[63] Continuation-in-part of Ser. No. 860,681, Mar. 30, 1992, abandoned.

[51] Int. Cl.[5] ..... A47L 9/20

[52] U.S. Cl. ..... 15/352; 15/347; 15/384; 55/337; 55/351; 55/472; 55/DIG. 3; 55/473

[58] Field of Search ..... 15/320, 347, 352, 353, 15/383, 384; 55/320, 337, 351, 472, 473, DIG. 3

[56] References Cited

U.S. PATENT DOCUMENTS

| | | | |
|---|---|---|---|
| Re. 32,357 | 10/1986 | Dyson . | |
| 403,462 | 5/1889 | Morse . | |
| 408,787 | 8/1889 | Ash . | |
| 664,135 | 12/1900 | Dufour | 15/384 X |
| 883,413 | 3/1908 | Mahony | 15/352 X |
| 942,657 | 12/1909 | Morse | 55/351 X |
| 2,135,036 | 11/1938 | Karlstrom | 15/347 X |
| 2,167,786 | 8/1939 | Taylor . | |
| 2,242,278 | 5/1941 | Yonkers et al. | 55/DIG. 3 X |
| 2,266,075 | 12/1941 | Replogle | 15/384 X |
| 2,323,405 | 7/1943 | Linderoth, Jr. . | |
| 2,422,825 | 6/1947 | Davis, Jr. . | |
| 2,500,747 | 3/1950 | Ellis . | |
| 2,511,598 | 6/1950 | Reeves . | |
| 2,661,810 | 12/1953 | Heth . | |
| 2,719,596 | 10/1955 | Kent et al. | 15/347 X |
| 2,768,707 | 10/1956 | Campbell | 55/320 X |
| 2,824,335 | 2/1958 | Moffat . | |
| 3,008,543 | 11/1961 | Bourdalé et al. . | |

(List continued on next page.)

FOREIGN PATENT DOCUMENTS

| | | | |
|---|---|---|---|
| 735230 | 5/1943 | Fed. Rep. of Germany | 15/352 |
| 382357 | 11/1964 | Switzerland | 15/352 |
| 2246717 | 2/1992 | United Kingdom | 15/347 |

OTHER PUBLICATIONS

Clarke Concept 4000 Brochure (8 Pages), no date.

Drytech Carpet Dry Cleaning System Brochure (2 Pages), no date.

*Primary Examiner*—Stephen F. Gerrity

*Attorney, Agent, or Firm*—Jansson & Shupe, Ltd.

[57] ABSTRACT

The improved carpet cleaning machine, intended for use with "dry" carpet cleaning systems using dampened granules or particles, can be used in either of two modes. One involves carpet "brushing" for dirt removal by urging particles into the carpet and along the fibers. The other involves later vacuuming for particle removal. To facilitate the latter, one embodiment of the machine has first and second particle-removing media such as a concentrically-mounted cyclone separator and conical screen filter, respectively. The separator has air flowing through it downwardly along a vortical path and then upward, such air flow often carrying along a few particles. Such high-velocity particles impinge on the outer surface of the screen filter and many particles adhering to such filter are dislodged. The filter is said to thereby be "purged" or cleaned. There may also be a third medium and even a fourth medium to remove very fine particles before the air is expelled back into the room. Other embodiments use an automotive, resilient foam or flat-element filter medium in place of or in addition to the conical screen filter.

23 Claims, 5 Drawing Sheets

U.S. PATENT DOCUMENTS

| | | | |
|---|---|---|---|
| 3,240,000 | 3/1966 | Hayes et al. | 55/337 |
| 3,308,609 | 3/1967 | McCulloch et al. | 55/337 X |
| 3,320,726 | 5/1967 | Black, Jr. . | |
| 3,320,727 | 5/1967 | Farley et al. . | |
| 3,339,348 | 9/1967 | Bratton et al. . | |
| 3,558,484 | 1/1971 | Carr | 55/337 X |
| 3,685,257 | 8/1972 | Burke . | |
| 3,691,735 | 9/1972 | Knierim . | |
| 3,716,967 | 2/1973 | Doyle, Jr. et al. | 55/337 X |
| 3,785,123 | 1/1974 | Leith . | |
| 3,802,570 | 4/1974 | Dehne . | |
| 3,870,486 | 3/1975 | Eriksson et al. . | |
| 3,877,902 | 4/1975 | Eriksson et al. . | |
| 3,887,344 | 6/1975 | Smith . | |
| 3,898,065 | 8/1975 | Coffman . | |
| 3,910,781 | 10/1975 | Bryant, Jr. | 15/347 X |
| 3,925,044 | 12/1975 | Tu et al. . | |
| 4,257,786 | 3/1981 | Sogo et al. . | |
| 4,261,713 | 4/1981 | Bourdois et al. . | |
| 4,268,288 | 5/1981 | Coombs . | |
| 4,353,721 | 10/1982 | Molistätter . | |
| 4,373,228 | 2/1983 | Dyson . | |
| 4,490,162 | 12/1984 | Davis . | |
| 4,511,474 | 4/1985 | Krishna et al. . | |
| 4,571,772 | 2/1986 | Dyson . | |
| 4,573,236 | 3/1986 | Dyson . | |
| 4,593,429 | 6/1986 | Dyson . | |
| 4,606,743 | 8/1986 | Shuman | 55/337 X |
| 4,643,748 | 2/1987 | Dyson . | |
| 4,695,299 | 9/1987 | Spadaro et al. | 55/337 X |
| 4,731,101 | 3/1988 | Kanda . | |
| 4,756,729 | 7/1988 | Brunnmair et al. . | |
| 4,790,865 | 12/1988 | DeMarco . | |
| 4,826,512 | 5/1989 | Fuller . | |
| 4,826,515 | 5/1989 | Dyson . | |
| 4,853,008 | 8/1989 | Dyson . | |
| 4,883,506 | 11/1989 | Ribnitz | 55/351 X |
| 5,006,135 | 4/1991 | Friesen . | |
| 5,013,342 | 5/1991 | Leussler et al. . | |
| 5,230,722 | 7/1993 | Yonkers | 15/353 X |

CARPET CLEANING MACHINE FOR PARTICULATE REMOVAL

RELATED APPLICATION

This application is a continuation-in-part of application Ser. No. 07/860,681 filed on Mar. 30, 1992, and now abandoned.

FIELD OF THE INVENTION

This invention relates generally to cleaning and, more particularly, to carpet cleaning.

BACKGROUND OF THE INVENTION

The three primary approaches used to clean commercial and residential carpets are steam or hot water, foam and dry systems. Dry-type carpet cleaning systems are further divided into two broad categories. One uses a dry or substantially dry powder and the other uses granules, each of which is several times larger than a powder grain. The granules are slightly moistened with cleaning solvents for dirt removal. The inventive machine has utility for both categories of dry systems but relates primarily to those using granules rather than powder. Such machine also has utility in situations where only carpet vacuuming is performed. That is, its long-bristled brushes are highly effective in removing loose sand and other soil not requiring the application of solvent-bearing material.

Of the dry granular carpet cleaning systems, the best known and most widely used is the HOST ® dry extraction system offered by Racine Industries, Inc. of Racine, Wis. The HOST ® system applies granules to carpet fibers using a machine as shown in Rench et al. U.S. Pat. Nos. 2,842,788 and 2,961,673. Such machine, sold under the HOST ® trademark, is devoid of vacuum capability and has a pair of spaced brushes counter-rotating at relatively low speed (about 350 rpm) to stroke the cleaning granules into, through and across the carpet and its fibers.

The granules are referred to as "dry" and are substantially so even though moistened with cleaning solvents. When stroked as described, these granules "scrub" dirt and soil from such fibers including oily and non-oily soil. The carpet is cleaned by working the HOST@ machine across it in different directions. During the cleaning process, granules migrate to the carpet backing adjacent the base of the fiber. A few granules also adhere lightly to the fibers along their lengths. Heretofore, conventional carpet vacuum machines have been used for removing these dirt-ladened granules.

S. C. Johnson Co. of Racine, Wis., sells a vacuum cleaning machine known as the VECTRON TM. Such machine is said to incorporate "dual cyclonic technology" which eliminates the need for a dust bag. The machine can be used for hand vacuuming using a wand. However, one must take the entire machine to the site to do so. The vacuum air stream is not required to flow through collected waste and it is not known whether such machine has a beater bar. An advertising brochure says the machine is "ideal for dry carpet cleaning systems." It is believed that this statement alludes to powder systems since the brochure goes on to say that the machine "does not exhaust powder." It is also believed that such machine is based upon one or both of the following U.S. Pat. Nos. 4,643,748; 4,853,008 (Dyson).

A difficulty attending the use of conventional machines for granule removal is that they perform less than optimally when vacuuming dried-out granules. Performance of such machines is even less satisfactory when vacuuming damp granules and longer carpet fibers further impair granule cleanup. Repeated passes of conventional machines over carpet surfaces are often used and, even at that, such machines fail to remove substantially all of the spent granules.

Whether damp or dry, such granules (at least those of the HOST ® product) do no damage whatever to carpet even though allowed to reside in the carpet for extended periods. But, through carpet usage, granules hidden after vacuuming work their way to the top of the carpet. They are considered by a few to be somewhat unsightly. An approach used by professional cleaners to overcome this is to perform additional vacuuming on one or more successive days—worthwhile even if only to remove newly-deposited dirt—to remove particles which emerge through use.

Yet another difficulty attending the use of conventional machines is that many use only a single filter medium, often a disposable paper bag. To the extent the machine picks up granular material, such bags fill rapidly and work must be suspended during bag disposal and replacement. And many bag/machine configurations draw air through the collected dirt. Vacuum efficiency drops rapidly as the bag fills.

Another disadvantage of conventional machines is that professionals using dry granular carpet cleaning methods are virtually required to invest in two machines, one for brushing the granules into the carpet during non-vacuum cleaning and a vacuum machine for later cleanup. Pairs of machines are cumbersome to move into, around in and out of work sites and represent a significant business investment.

"Dual-mode" (cleaning and vacuum) machines are available for cleaning carpet but they use a dry powder rather than granules. One such machine is made by Clarke-Gravely Corporation of Muskegon, Mich. and sold as the CLARKE CAPTURE carpet cleaning system. Such machine distributes cleaning powder onto the carpet and works the powder into and through the carpet fibers using a round, disk-like scrubber brush, the axis of rotation of which is normal to the carpet surface. Since the machine vacuum system operates to reduce dust rather than recover dirty powder, one is still required to use a separate conventional vacuum machine to remove such powder.

Another type of system used for cleaning carpets with powder is the DRYTECH cleaning machine sold by Sears, Roebuck & Company. The machine has a self-contained vacuum capability and one beater bar with several rows of short-bristled brushes. Such bar is within a shroud which generally conforms to the shape of the bar and by which vacuum is selectively applied. As the brush alone is rotated at high speed, powder is dispensed through two slits, one on either side of the bar between the bar and the shroud. Later, the vacuum is actuated and dry powder (with dirt entrained) is said to be dislodged by the brush and drawn away by vacuum.

A failure of a machine, like the DRYTECH machine, to fully recover powdered cleaner is often not recognized by the site owner/user. This is so since such powdered cleaner is virtually invisible even if distributed on the carpet surface.

Another consideration in machine selection is whether or not the filter media are self-cleaning to any degree. Ways to accomplish forced air cleaning of filter media (although not necessarily in a carpet vacuum machine) are shown in U.S. Pat. Nos. 3,898,065 (Coffman), 2,500,747 (Ellis), 4,826,512 (Fuller), 4,261,713 (Bourdois et al.) and 3,320,726 (Black, Jr.). They describe the use of air jets or air blasts in one way or another to knock dirt off of a filter. There are several variations to this basic approach. One is simply to "pulse" the filter periodically with one or more air jets. In one such arrangement (shown in the Ellis patent), the filter media are rotated so that the air jets sweep across the media surface once for each revolution. Another variation includes backwashing the filter with air; that is, air flows through the filter in a direction opposite normal flow. The Fuller, Bourdois et al. and Black, Jr. patents illustrate this approach.

U.S. Pat. Nos. 3,785,123 (Leith) and 3,685,257 (Burke) describe filter cleaning using air in other ways. The Burke patent describes cleaning of the inner or outer surfaces of cylindrical filter bags using traveling vortex gas rings. Such rings appear to be donut shaped regions of high velocity air movement. The cleaning method shown in the Leith patent uses traveling turbulent air flow to "ripple" filter bags and clean particulates from the bag inner surface. The traveling turbulent air flow results from counter-rotation of inner and outer concentric cylinders.

vacuum cleaning machines using cyclone separators are shown in representative U.S. Pat. Nos. 4,826,515 (Dyson) and 3,877,902 (Eriksson et al.). Amway Corporation has a Carpet Maintenance System CMS 1000 machine which uses a conventional "beater bar" brush with spirally-arranged brush tufts. Air flow is understood to be first through a cylindrical collection chamber at high velocity, then through a cyclone separator at higher velocity and then through a "HEPA" filter located below a cylindrical collection chamber. The machine is said to have "parallel dual centrifugal separation chambers." It also has a transparent removable waste collection compartment.

OBJECTS OF THE INVENTION

It is an object of the invention to overcome some of the problems and shortcomings of the prior art.

Another object of the invention is to provide an improved machine capable of both cleaning carpets using a dry granular system and subsequent vacuuming of carpets for granular removal.

Still another object of the invention is to provide an improved machine avoiding use of conventional disposable dust-collecting filter bags.

Yet another object of the invention is to provide an improved machine highly effective in removing cleaning granules from carpets, particularly including damp granules.

Another object of the invention is to provide an improved machine having plural granule-removing media.

Another object of the invention is to provide an improved machine which helps avoid or entirely eliminates the need to invest in separate cleaning and vacuuming machines. How these and other objects are accomplished will become apparent from the following description taken in conjunction with the drawing.

SUMMARY OF THE INVENTION

The improved carpet cleaning machine is based upon the machine shown in U.S. Pat. No. 2,842,788 (Rench et al.) which is incorporated herein by reference. Such machine is configured for use with what is known as a "dry" carpet cleaning method, so named because it is substantially dry and involves no destructive water or steam application to carpet. The leading example of a dry method is the HOST® method carried out using HOST® carpet cleaning granules (as well as other HOST® products), all originating from Racine Industries, Inc. of Racine, Wis. As a profile of size, 99% of the HOST® granules are 125 microns and larger, 72% are 300 microns and larger and 36% are 425 microns and larger.

The HOST® granules, small cellulosic particles, are dampened at the factory with fiber-cleaning chemicals. In use, the granules are distributed generally evenly on the top of the carpet and then worked in and through the carpet and along the carpet fibers using a special machine supported on a pair of counter-revolving brushes. Dirt is removed from the carpet by being picked up by the granules which are then removed by vacuuming. The improved machine is particularly adept at recovering very damp granular material, a task for which conventional vacuum cleaners are less than ideally suited.

The improved carpet cleaning machine removes granular and other types of particulate material from carpet. Such machine has at least one brush dislodging the particles from the carpet and a vacuum system powered by an electric motor for drawing the dislodged particles into a moving air stream. The machine also has a pod with first and second particle-removing media in the air stream. Such first and second media comprise a cone-like separator and a mesh filter, respectively.

The first medium removes many particles, especially larger particles, and the second medium removes most (and, in some instances, virtually all) of those particles not removed by the first medium. Those few particles not removed by the first medium continue to be entrained in the air stream moving in the first medium and such particles impinge on the second medium. This arrangement provides a unique feature involving pneumatic "purging" of the second medium to dislodge particles from it.

It has been discovered that significant portions of the filtering area of the second medium are kept relatively free of collected particles. Such purging of the second medium is very likely because particles not removed by the first medium and entrained in the turbulent air stream within the machine strike the second medium at relatively high velocity and knock or purge particles from it. It is also possible that some purging occurs because of the high velocity air per se.

The first and second media are preferably of disparate types selected to remove particles of differing sizes from air flowing through the pod. The first medium has air flowing downward along what is termed a vortex-like or vortical path. Turbulent air then follows an upward path and impinges on and passes through the second medium.

A benefit of this unique arrangement is that the "service life" of the second medium is extended. That is, one may use the machine for longer periods without cleaning such medium or, if it is of the throw-away replaceable type, without replacing it.

In a highly preferred embodiment, the first medium is of a type which removes particles by centrifugal action. Such type is exemplified by a cone-shaped cyclone separator. Such separator has a tangential air inlet which flows air to an air-guiding device such as a channel at the interior top (larger diameter) portion of the separator. The channel guides air along the path and helps prevent such air from "short-circuiting" and flowing directly through the second medium.

The second medium is of a type which removes particles primarily by mechanical interference with particle movement. Pleated paper or cloth filter cartridges typify such a medium as does a fine-mesh, conical, metal screen filter. The latter is preferred in that it is relatively rigid and readily removable for manual cleaning.

The media, e.g., cyclone separator and conical screen filter, are generally conformably shaped to one another and have surfaces spaced generally equidistant from one another along a length. Although the second medium removes particles from the air stream primarily by mechanical interference, it has been found that some particles are removed by cyclonic action. Particles removed in that way tend to collect inside the second medium, i.e., on the side opposite that on which air impinges for purging.

Preferably, the machine also includes a third particle-removing medium to remove very fine particulate matter from air expelled from the machine. Like the second medium, the third medium is of a type removing particles by mechanical interference with particle movement. One type of preferred third medium is made of open cell foam having a soft, flexible structure. Such third medium removes very fine, dust-like particles from the air stream before the air is expelled into the room or space in which the machine is working. A soft, foam-type third medium can be readily washed as necessary to remove any dust accumulated thereon. Another type of third medium is a relatively rigid automotive-type filter.

Yet another type of third medium is a generally flat filter mat. Such mat may be in sheet form in a slide-out tray for easy filter removal and replacement. Or it may be ribbon-like and fed from a dispenser. The machine may include a manual or automatic mat-advancing mechanism whereby dirt-laden filter mat is replaced by clean filter mechanism. In one arrangement, the mechanism monitors a vacuum motor characteristic, e.g., speed or current, and replaces mat when the characteristic is equal to a predetermined value. Such value is selected to "signal" that the mat is clogged to the point that the motor is cavitating. In another arrangement, the mechanism monitors a mat characteristic, e.g. pressure drop across it, and replaces mat when the characteristic is equal to a predetermined value.

The machine is intended for use primarily by professional cleaners ("PCs") in the business of cleaning carpets, often in commercial and institutional sites. In such situations, the PC usually cleans large areas of carpet and following such cleaning, vacuums up the dirt-laden granules. Any impediment to the cleaning effort causes a loss in productivity and business profitability. Owning separate brushing and vacuuming machines entails an additional capital expenditure and extra effort in moving machines from place to place. And while productivity and profitability are of less concern to do-it-yourself homeowners, they , like the PCs, will appreciate the utter ease with which the machine is operated and the resulting, greatly reduced operator fatigue.

The machine is entirely supported on a pair of long-bristled, counter-revolving brushes. A vacuum nozzle is mounted between the brushes for removing dirt-laden particles from carpet following brush-aided carpet cleaning operations. Such nozzle is detachably connected to the pod to facilitate pod removal.

And a preferred machine also includes a port for attaching a hand-manipulated vacuum head to the pod. Such head can be used to clean "small-area" carpet, e.g., stair treads and the like, which are usually too small to readily support the machine.

The brushes "stroke" carpet cleaning granules through the carpet and along the carpet fibers for cleaning. And after cleaning is completed, such brushes dislodge granules from the carpet for vacuum particle removal and a brush shroud prevents the dislodged particles from being randomly thrown about. Such shroud terminates in a lower edge or perimeter which is spaced somewhat above the carpet.

During carpet cleaning, the space between the shroud edge and the carpet permits granules to "fly out" from beneath the machine and be re-distributed on the carpet. However, more efficient granule retrieval results when a movable skirt is provided for selectively closing at least a portion of that space—and preferably substantially the entirety of the space—during vacuuming.

The machine has front and rear sections and includes a handle mounted for "wide-arc" pivoting movement. The machine operator can thereby position the handle so that carpet proximate to a wall may be cleaned with either section. As fitted and used for vacuuming, the brush-supported machine with its wide-arc pivoting handle is incredibly easy to move across carpet—significantly easier than a conventional vacuum machine with wheels. And the handle may be latched in a position permitting application of tipping force to the machine. As described below, slight machine tipping fore or aft provides "self-propulsion" and reduces the already-low effort required for machine maneuvering.

Further details of the improved machine are set forth in the detailed description taken in conjunction with the drawing.

DETAILED DESCRIPTION OF PREFERRED EMBODIMENTS

Figures 1, 2:
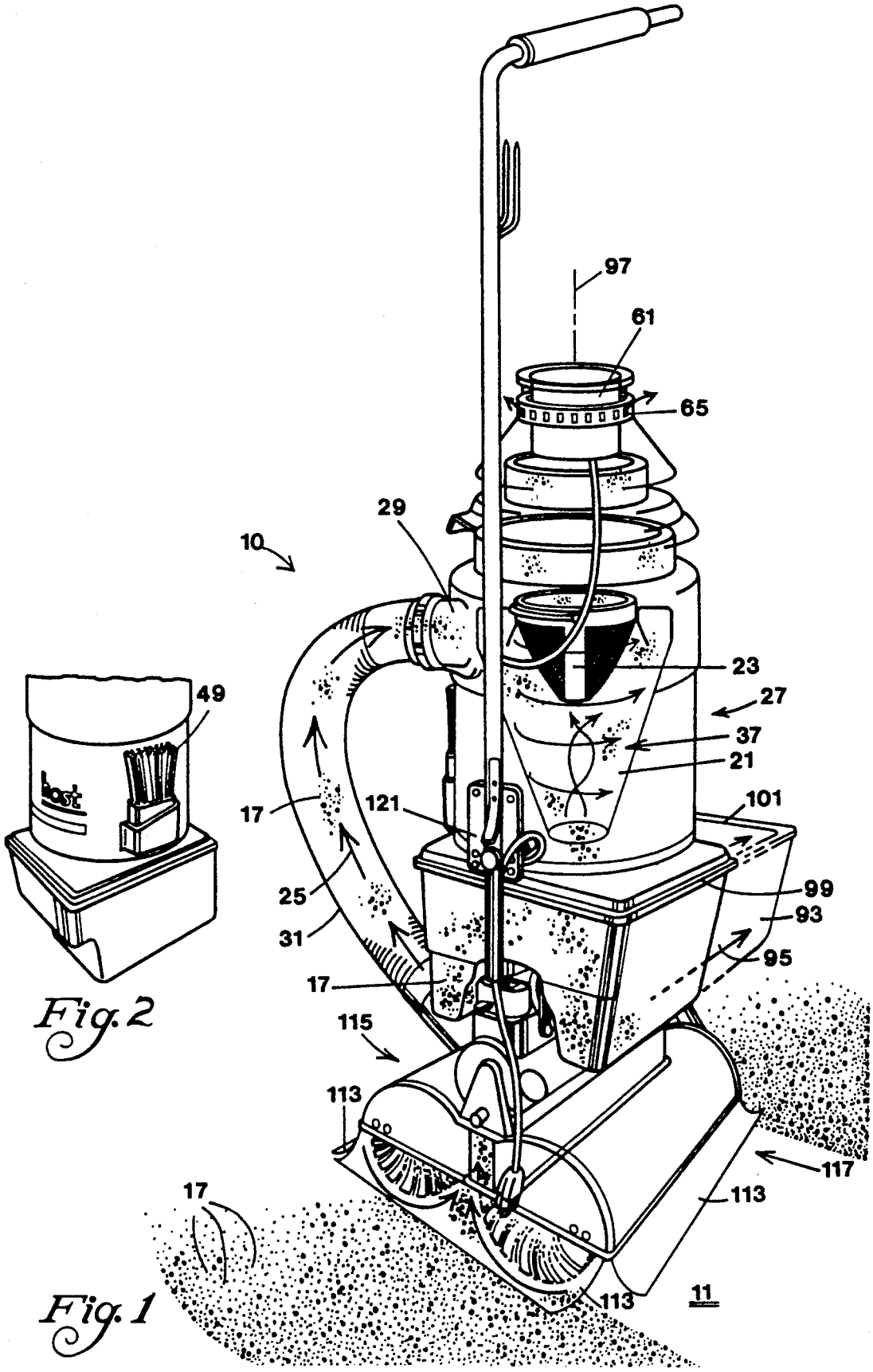
FIG. 1 is an angled elevation perspective view of a composite arrangement of the improved machine with parts shown in phantom.
FIG. 2 is an elevation view of a portion of the machine shown in FIG. 1 taken from a different perspective.
Figure 3:
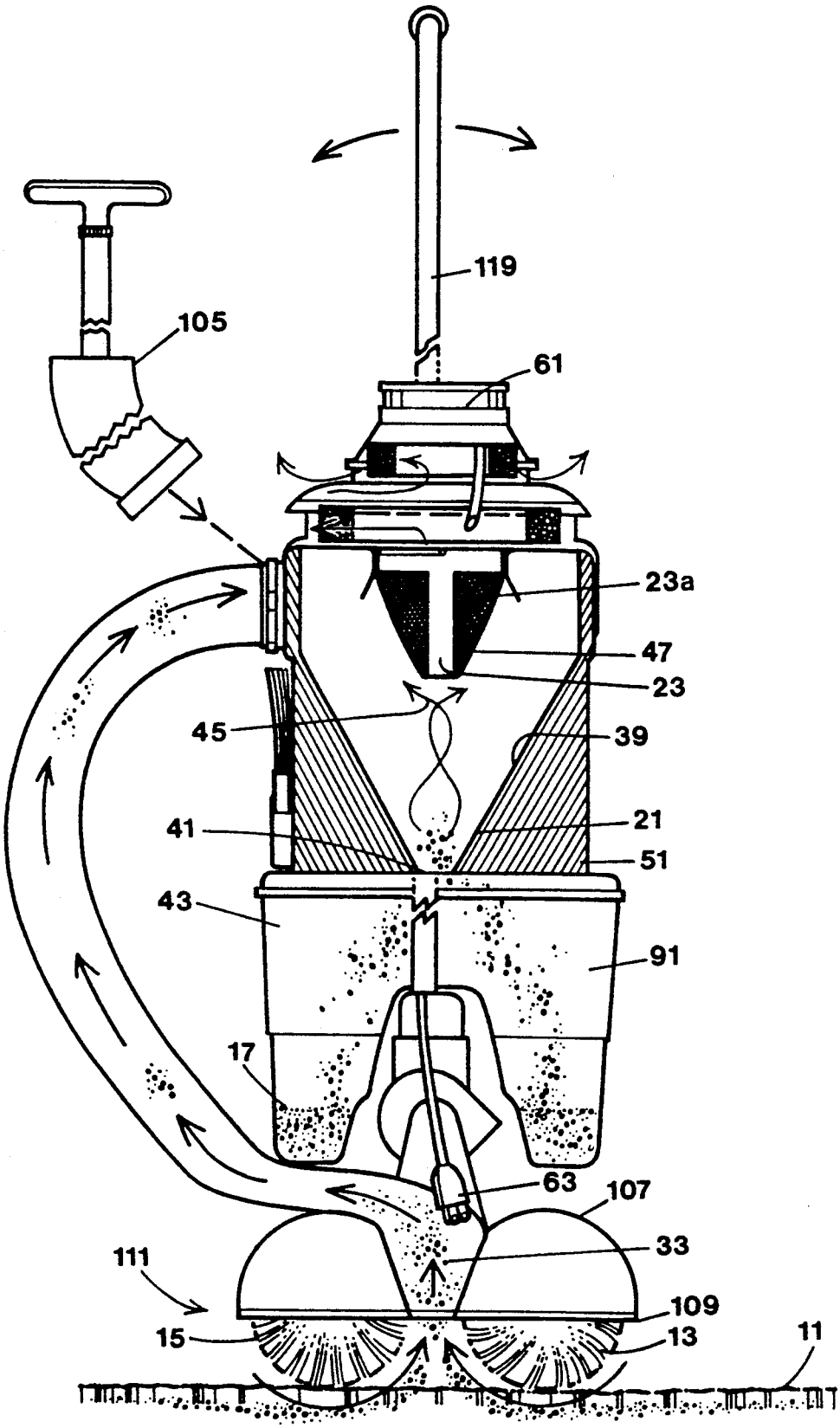
FIG. 3 is a side elevation perspective view of the machine shown in FIG. 1 with parts shown in phantom.

Referring first to FIGS. 1-3, the improved machine 10 cleans carpet 11 in two sequential steps. The basic machine 10 is supported on and uses two counter-revolving brushes 13, 15 to stroke predeposited, solvent-moistened particles or granules 17 (preferably HOST ® cleaner) into and across carpet fibers as described above. While the improved machine 10 is extremely effective in removing such granules 17, especially including damp granules 17, it has significant utility for removing other types of foreign matter (including powder-like "fines") from carpet 11.

As used herein and as used to describe particle size, "coarse" means about 25 microns and larger, "intermediate" means in the range of about 5 to 25 microns and "fine" means below about 5 microns. Common experience demonstrates that carpets can have embedded therein foreign objects, caked mud, dust and the like of sizes ranging from coarse to fine. To help understand particle size, a rough rule of thumb is that a 10 micron particle 17 is about the smallest that can be seen by the unaided human eye.

The improved machine 10 includes first and second particle-removing media, 21 and 23, respectively. The media 21, 23 are preferably of disparate types selected to remove particles of differing sizes from air 25 flowing through the pod 27. The first medium 21 is preferably of a type which removes particles 17 by centrifugal action. Such type is exemplified by a cone-shaped cyclone separator 21*a*.

The separator 21*a* has a tangential air inlet 29 connected by a detachable hose 31 to a vacuum nozzle 33 positioned between the brushes 13, 15. Dirt-laden particles 17 are carried along the hose 31 by a high velocity air stream directed to an air-guiding channel 35 at the interior top (larger diameter) portion of the separator 21*a*. The channel 35 guides air toward and along a generally downward, vortex-like or vortical, spiral path 37 and helps prevent such air from "short-circuiting" and flowing directly to and through the second medium 23. As air laden with dirty particles 17 increases in velocity as it flows along the vortical path 37, heavier particles 17 are "thrown" to the wall 39 of the separator 21*a* and fall through the opening 41 into the waste collection bin 43.

It has been found that the cyclone separator 21*a* removes damp or wet HOST ® granules and particles 17 down to about 3 microns in size. On the other hand, if the HOST ® granules and particles 17 are dry, the separator 21*a* removes those of about 15 microns and larger. And, of course, the degree to which particles 17 sized between 3 microns and 15 microns are removed depends upon the relative dampness of such particles 17 which may have come in contact with HOST ® granules.

After passing along the vortical path 37, "rolling" turbulent air (usually with some particles still entrained) follows an irregular path 45 generally upward and impinges on and passes through the second medium 23. The arrows representing the spiral path 37 have been omitted from FIG. 3 to better show the path 45. Depending upon their size and dampness, particles 17 entrained in the upward-moving air stream will be trapped by the second medium. Preferably, the separator 21*a* and air velocity are selected to remove dry particles 17 about 15 microns and larger and the second medium 23 is selected to remove such particles 17 of about 5 microns and larger. However, it has been discovered that when the particles 17 are damp, those somewhat smaller than 5 microns tend to adhere to the second medium 23.

In certain arrangements, the machine 10 incorporates a unique feature by which the second medium 23 is at least partially purged to dislodge particles 17 from it. That is, significant portions of the filtering area of the second medium 23 are kept relatively free of collected particles 17. Such purging of the second medium 23 is very likely because particles 17 not removed by the first medium 21 and entrained in the turbulent air stream flowing within the machine 10 along path 45 strike the second medium 23 at relatively high velocity and knock or purge particles 17 from it. It is also possible that some purging occurs because of the high velocity air per se.

The second medium 23 is of a type which removes particles 17 primarily by mechanical interference with particle movement. Pleated paper or cloth filter cartridges typify such a medium 23 as does a fine-mesh, conical, metal screen filter 23*a*. The latter is preferred in that it is easily removable for manual cleaning and because of its rigidity, it lasts longer than replaceable "throw-away" types of media. A metal mesh re-usable coffee filter 23*a* made by Krups has been found to be highly satisfactory. As shown in FIG. 2, cleaning of the lift-out filter 23*a* is with a small broom 49 stowed on the machine 10.

The media, e.g., cyclone separator 21*a* and conical screen filter 23*a* are generally conformably shaped to one another and have surfaces (like wall 39 and surface 47) spaced generally equidistant from one another along a length "L". Although the second medium 23 removes particles 17 from the air stream primarily by mechanical interference, it has surprisingly been found that some particles 17 are removed by cyclonic action. Particles 17 removed in that way tend to collect inside the second medium 23, i.e., on the side opposite surface 47 on which air impinges.

Figure 5:
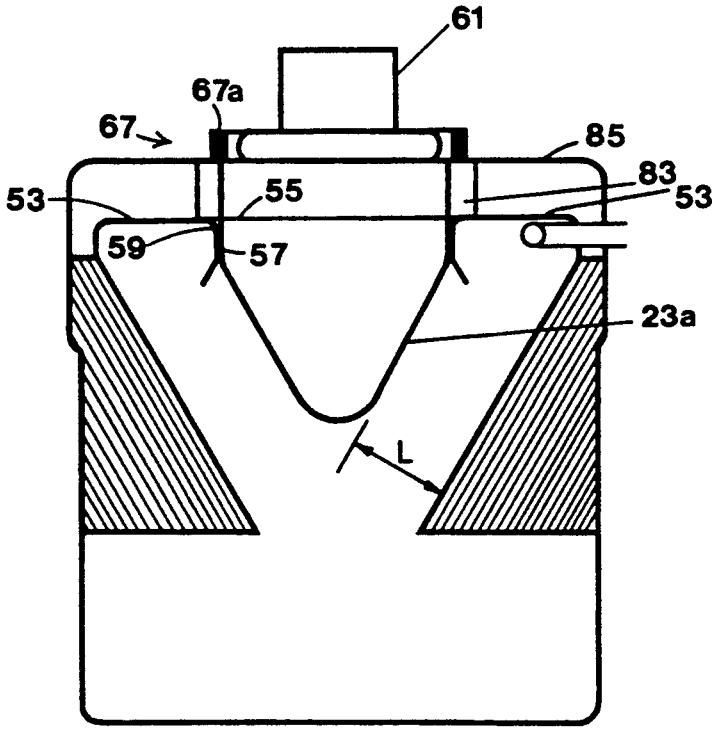

As shown in FIGS. 1, 2 and 5, the media 21, 23 are mounted and housed in a generally-cylindrical canister 51 atop the bin 43. In "working" position, the top edges 53, 55 of the media 21, 23, respectively, are generally coplanar. And the upper rim 57 of the medium 23 and interior surface 59 of the channel 35 are selected to have generally corresponding diameters. In that way, the second medium 23 can "nest" in and seal against the first medium 21.

An electrically-powered, vacuum-creating blower 61 (with a separate electrical plug 63) is atop the pod 27 and is of a type drawing air in through the bottom of the blower 61 and expelling it through radial ports 65. Such blower 61 thereby provides the high velocity air stream starting at the vacuum nozzle 33 and ending with air expulsion from the blower 61.

Referring additionally to FIGS. 4–8, for some applications, the machine 10 also includes (in addition to first and second media 21, 23) a third particle-removing medium 67 to remove fine particulate matter from the air stream. Like the second medium 23, the third medium 67 is of a type removing particles by mechanical interference with particle movement.

One type of preferred third medium 67 is an open cell foam filter 67*a* having a soft, flexible structure. It removes fine, dust-like particles 17 from the air stream before the air is expelled into the room or space in which the machine 10 is working. A soft, foam-type third medium 67 can be readily washed as necessary to remove any dust accumulated thereon. Another type of third medium 67 is a relatively rigid automotive-type filter 67*b*.

Figure 4:
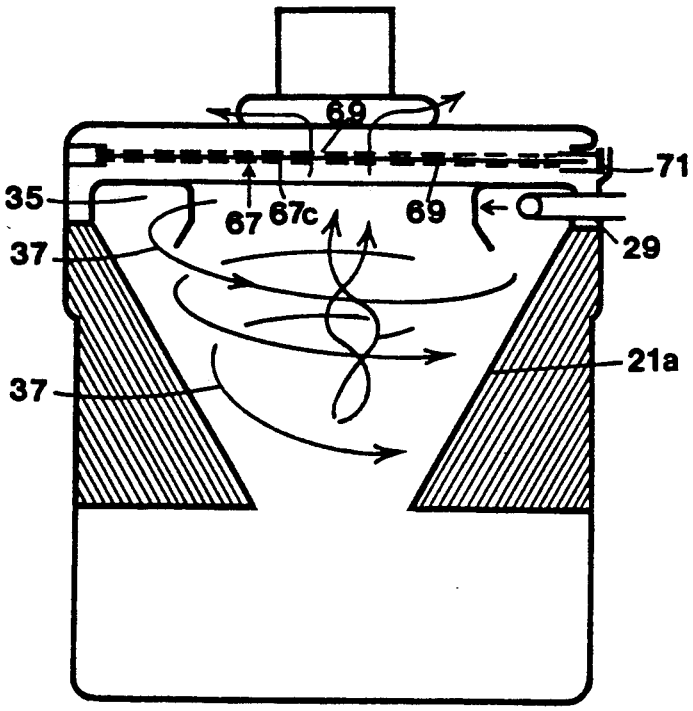
FIGS. 4 through 8 are simplified cross-sectional elevation views showing various arrangements of filter media.
Figure 6:
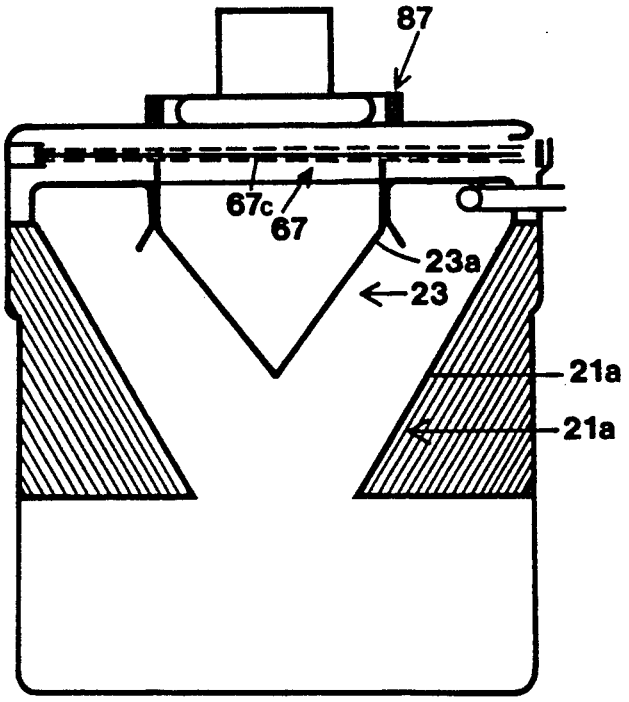
Figure 8:
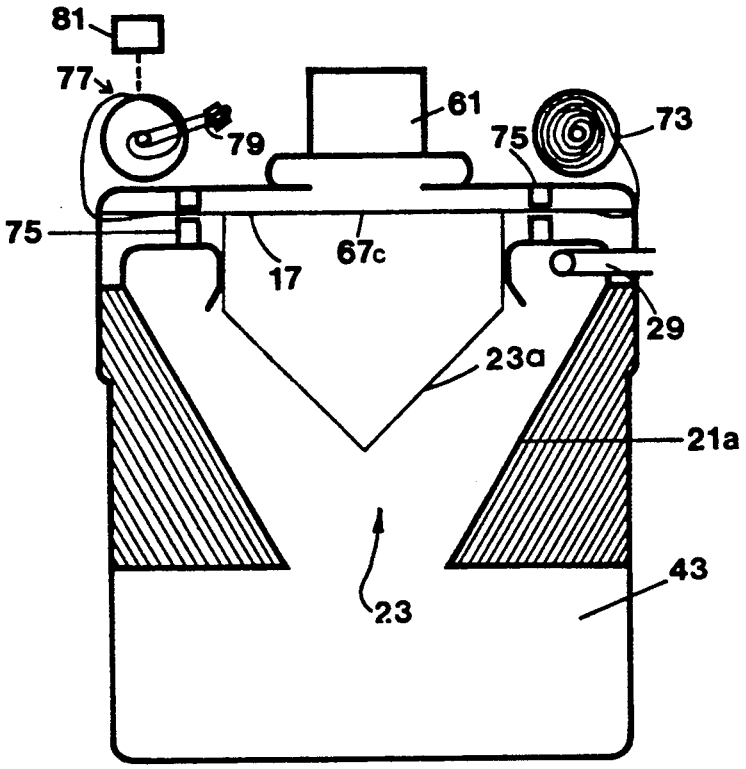

Yet another type of third medium 67 is a generally flat filter mat 67*c* as shown in FIGS. 4 and 6. Such mat 67*c* is in sheet form interposed between coarse wire mesh retainers 69, all in a slide-out tray 71 for easy mat removal and replacement. Or, as shown in FIG. 8, it is ribbon-like and fed from a dispenser 73. Upper and lower perimeter seals 75 prevent air leakage around the mat 67*c*.

The machine 10 may include a manual or automatic mat-advancing mechanism 77 whereby dirt-laden filter mat 67*c* is replaced by clean filter mat 67*c*. In FIG. 8, the mechanism 77 is manually operated by a crank 79. Or the mechanism 77 may be driven by an electric motor 81.

In the latter arrangement, the mechanism 77 may be configured and arranged to monitor a blower motor characteristic, e.g., speed or current. When the mat 67*c* is clogged at least to some degree, the blower 61 partially cavitates and its speed increases. Simultaneously, motor current decreases because of the reduced load. The mechanism 77 replaces mat 67*c* when the characteristic is equal to a predetermined value "signalling" that mat clogging or "loading" has reached an undesirable level.

In another arrangement, the mechanism 77 monitors a mat characteristic, e.g, pressure drop across it. Such pressure drop is sometimes referred to as "pressure differential." With increasing mat clogging, the pressure drop or differential across it increases. Mat 67*c* is replaced when such pressure drop increases is equal to a predetermined value.

Figure 7:
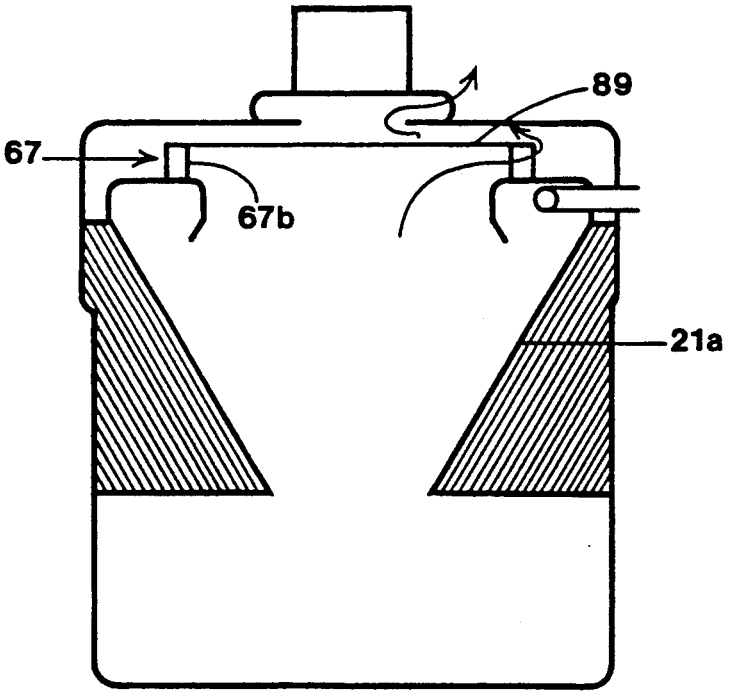

It is to be appreciated that several combinations of particle-removing media are possible. For example, the cone shaped medium 23*a* can be omitted and the separator 21*a* and mat 67*c* used as shown in FIG. 4. In the arrangement of FIG. 5, the cone shaped medium 23*a* is used with an open-cell foam filter 67*a* or such filter 67*a* is replaced with an automotive-type rigid filter 67*b*. A seal ring 83 fits between the top edge 53 of the separator 21*a* and a cover 85 to prevent air leakage. FIG. 6 shows a "four media" configuration including a cyclone separator 21*a* as the first medium 21, a conical metal-screen filter 23*a* as the second medium 23, a filter mat 67*c* as the third medium 67 and a foam filter 67*a* or an automotive-type filter 67*b* as the fourth medium 87. FIG. 7 shows an arrangement using a cyclone separator 21*a* with an automotive-type filter 67*b* atop it. Air flow is "inside out" through the filter 67*b* which is capped with an imperforate cover 89.

As explained above, carpet cleaning using granules 17 or powder-like cleaners is performed in a sequence of brush-aided carpet cleaning followed by brush-enhanced carpet vacuuming. To that end, the particle-removing media 21, 23, 67, 87 (to the extent such media are used) are mounted with a pod 27 removable from the machine 10 during carpet brushing thereby reducing machine weight and bulk. The pod 27 includes a bin 43 collecting waste particles 17 removed from the air flow path 37 by the first medium 21 as well as those purged from the second medium 23. Dirty waste particles 17 removed from the air flow path 37 fall into the bin 43 so that particle-entraining air does not pass through the waste particles 17 as with many conventional vacuum cleaners. The bin 43 has a transparent panel 91 so the user can easily see when it is full. And the bin drawer 93 is detachable from the pod remainder for disposing of particles 17 collected therein. Detachment is by sliding the drawer 93 along an axis 95 normal to the axis 97 of the pod 27.

The pod 27 is equipped with a seal 99 and the drawer 93 has an edge 101 adjacent to (i.e., spaced slightly from or lightly in contact therewith) so the drawer 93 can be easily removed. During vacuuming, the edge 101 is urged by slight pressure differential to substantially particle-tight engagement with such seal 99 so that particles 17 are prevented from escaping from the bin 43. Of course, as an alternative arrangement, the seal 99 may be on the drawer 93 and the edge 101 be part of the pod 27.

The machine 10 is preferably entirely supported on a pair of long-bristled, counter-revolving brushes 13, 15. The vacuum nozzle 33 is between the brushes 13, 15 for removing dirt-laden particles 17 from carpet 11 following brush-aided carpet cleaning operations. The nozzle 33 is detachably connected to the pod 27 by the hose 31 to facilitate pod removal. The hose connection port 103 on the pod 27 is also used (as an alternative to machine vacuuming) to attach a hand-manipulated vacuum wand 105 to the pod 27. Such wand 105 can be used to clean "small-area" carpet, e.g., stair treads and the like, which have an insufficient surface area to readily support the machine 10.

Referring particularly to FIGS. 1 and 3, the brushes 13, 15 "stroke" carpet cleaning granules 17 through the carpet 11 and along the carpet fibers for cleaning. A brush shroud 107 prevents particles 17 from being randomly thrown about, especially upward toward the machine operator. Such shroud 107 terminates in a lower edge or perimeter 109 which is spaced somewhat from the carpet 11. During carpet cleaning, the space 111 permits many granules 17 to "fly out" from beneath the machine 10 and be re-distributed on the carpet 11. However, more efficient granule retrieval results when a movable skirt 113 is provided for selectively closing at least a portion of that space 111—and preferably substantially the entirety of the space 111 around the perimeter 109 of the shroud 107—during vacuuming.

The machine has front and rear sections 115, 117, respectively and includes a handle 119 mounted for "wide-arc" pivoting movement. The machine operator can thereby position the handle 119 so that carpet 11 proximate to a wall may be cleaned with either section 115, 117. And the handle 119 includes a latch 121 locking the handle 119 in a position permitting application of tipping force to the machine 10. Slight machine tipping fore or aft causes the brush 13, 15 at the rear or front section 117, 115, respectively, to "mesh into" the carpet 11, thereby provide a degree of self-propulsion and reduce the already-low effort required for machine maneuvering.

And it is to be appreciated that the pod 27 is detachable from the machine 10 for performing separate vacuuming tasks while the machine 10 is used for brushing granules. The pod 27 includes the upper canister 51, a waste-collecting bin 43, a hand-manipulated vacuum wand 105 and a motor-driven vacuum blower 61 mounted atop the canister 51. It also includes canister-mounted first and second particle-removing media 21, 23 of disparate types. Like those of the machine 10 described above, such media 21, 23 are selected to remove particles of differing sizes from air drawn through the wand 105 and the canister 51 by the blower 61. The pod 27 can simply be demounted and detached from the machine 10 and is self-contained for hand vacuuming of carpet. And of course, the pod 27 may also include a third particle-removing medium 67 for filtering fine particles 17 from the air stream.

While the principles of the invention have been described by way of examples, the invention is not intended to be limited by such examples. Other arrangements contemplated by the invention are possible.

We claim:

1. An improved machine for removing dirt-laden particles from a carpet and including:

at least one machine-mounted brush dislodging the particles from the carpet;

a machine-mounted vacuum system drawing the dislodged particles into a moving air stream;

first and second particle-removing media in the air stream, the first medium comprising a cone-shaped separator and the second medium comprising a mesh filter;

the first medium having air-entrained particles moving therein and impinging on the second medium;

a portion of the particles adhering to the second medium being dislodged by the air-entrained particles impinging on the second medium, thereby puring the second medium.

2. The machine of claim 1 wherein the first medium removes particles by centrifugal action.

3. The machine of claim 2 wherein the machine includes an air flow path, the first medium includes an air inlet and a device to guide air along the path whereby air is substantially prevented from flowing from the inlet directly through the second medium.

4. The machine of claim 3 wherein the air flow path includes a vortical portion, the first medium is a cyclone separator and the device is a channel guiding air along such vortical portion.

5. The machine of claim 4 wherein such separator has a top portion and the channel is at such portion.

6. The machine of claim 2 wherein the second medium removes some particles by cyclonic action.

7. The machine of claim 1 further including a third medium removing fine particulate matter from air being expelled from the machine.

8. The machine of claim 7 wherein the third medium has a soft, flexible structure permitting washing of the third medium.

9. The machine of claim 7 wherein the third medium is a relatively rigid automotive-type filter.

10. The machine of claim 7 wherein the third medium is a generally flat filter mat.

11. The machine of claim 10 wherein such filter mat is in a slide-out tray for easy mat removal and replacement.

12. The machine of claim 10 wherein such filter mat is ribbon-like and fed from a dispenser.

13. The machine of claim 12 including a mat-advancing mechanism whereby dirt-laden filter mat is replaced by clean filter mat.

14. The machine of claim 13 including a vacuum motor and wherein the mechanism monitors a vacuum motor characteristic and replaces filter mat when such characteristic is equal to a predetermined value.

15. The machine of claim 13 wherein the matadvancing mechanism monitors a characteristic of the dirt-laden filter mat and replaces the dirt-laden filter mat when such characteristic is equal to a predetermined value.

16. The machine of claim 1 including a pair of cylindrical, counter-revolving brushes supporting the machine and dislodging particles from the carpet for vacuum particle removal.

17. The machine of claim 16 including:

a shroud terminating in a lower perimeter above the carpet to define a space therebetween;

a movable skirt for selectively closing at least a portion of the space between the perimeter and the carpet during carpet vacuuming.

18. The machine of claim 17 including a nozzle between the brushes for removing dirt-laden particles from carpet by vacuum.

19. The machine of claim 18 wherein the skirt is configured to selectively close substantially the entirety of the space.

20. The machine of claim 19 including a port for attaching a hand-manipulated vacuum head for use in cleaning carpet.

21. The machine of claim 18 having front and rear sections and including a handle mounted for wide-arc pivoting movement whereby carpet proximate to a wall may be cleaned with either section.

22. The machine of claim 21 wherein such handle may be latched in a position permitting application of tipping force to the machine.

23. The machine of claim 16 including a nozzle between the brushes for removing dirt-laden particles from carpet by vacuum.

* * * * *